United States Patent [19]

Raccah et al.

[11] Patent Number: 4,555,232

[45] Date of Patent: Nov. 26, 1985

[54] HAIR DRYING APPARATUS

[76] Inventors: Edward R. Raccah, Southern Leigh, Blackberry La., Lingfield, Surrey; James B. King, 5 Wardrobe Ct., 146a Queen Victoria St., London EC4V 5AT, both of England

[21] Appl. No.: 486,538

[22] PCT Filed: Aug. 13, 1982

[86] PCT No.: PCT/GB82/00255

§ 371 Date: Apr. 12, 1983

§ 102(e) Date: Apr. 12, 1983

[87] PCT Pub. No.: WO83/00607

PCT Pub. Date: Mar. 3, 1983

[30] Foreign Application Priority Data

Aug. 14, 1981 [GB] United Kingdom ..... 8124971

[51] Int. Cl.[4] ..... A45D 20/06; F24H 1/00

[52] U.S. Cl. ..... 432/222; 432/219; 431/255; 431/344; 34/99; 34/97

[58] Field of Search ..... 432/222, 219; 126/405, 126/407, 412; 34/99, 97; 431/344, 255

[56] References Cited

U.S. PATENT DOCUMENTS

| | | | |
|---|---|---|---|
| 1,963,345 | 6/1934 | Zwilling | 431/255 |
| 2,396,821 | 3/1946 | Breese | 431/344 |
| 2,410,478 | 11/1946 | Breese | 431/344 |
| 2,666,480 | 1/1954 | Peterson | 431/344 |
| 3,179,156 | 4/1965 | Weiss et al. | 431/344 |
| 3,301,308 | 1/1967 | Briggs | 432/222 |
| 3,873,262 | 3/1975 | Pogrell | 431/255 |

FOREIGN PATENT DOCUMENTS

| | | |
|---|---|---|
| 688039 | 12/1978 | Belgium . |
| 3103843 | 9/1982 | Fed. Rep. of Germany . |
| 1459311 | 11/1966 | France . |

*Primary Examiner*—Henry C. Yuen

*Attorney, Agent, or Firm*—Emory L. Groff, Jr.

[57] ABSTRACT

A portable hair drying apparatus has a tubular body (60) with an air inlet at one end also containing an electric motor driving impeller (73) and powered by rechargeable cells (74). The air flows over a gas burner assembly (61) fed with gas from a liquid gas container (78) via valve means (69). The container (78) may be recharged through valve (69) or detached at a coupling joint (79) and replaced. The gas burner (61) may comprise a tube surrounded by a catalyst impregnated fibre forming a flameless catalytic gas burner. The gas burner may be separated from direct contact with the air flow by means of a heat pump, one end of which is heated by the burner with the other end being located in the air flow.

2 Claims, 7 Drawing Figures

Figure 3:
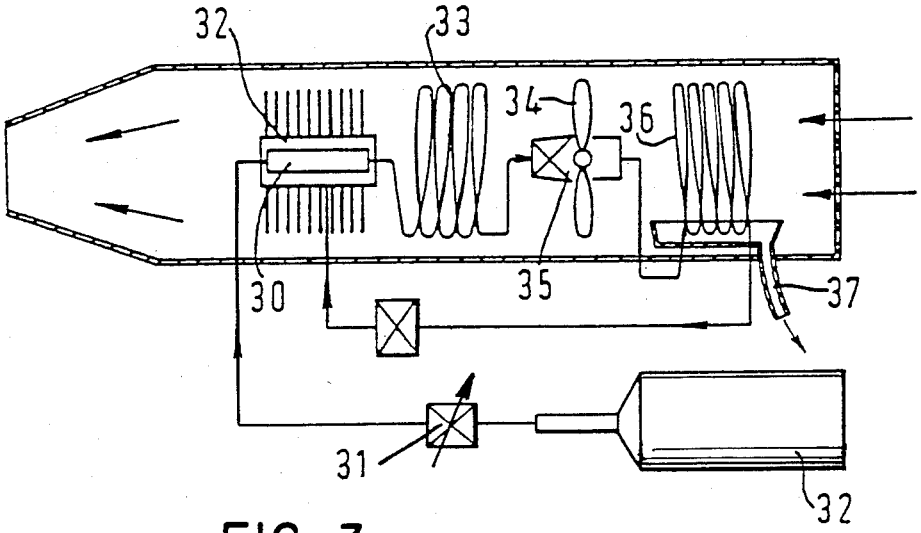

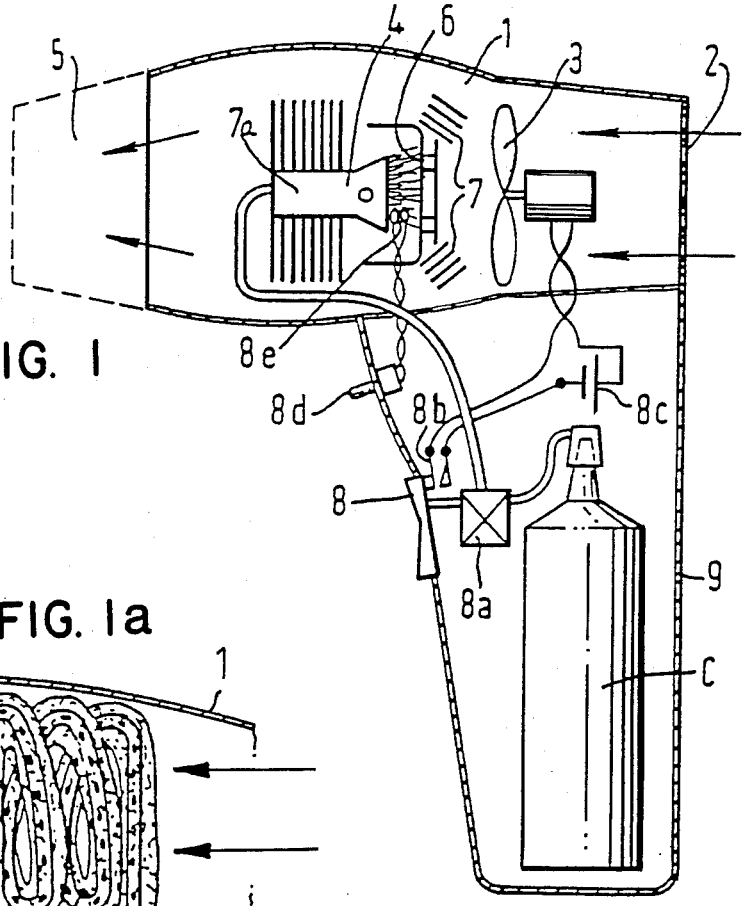
FIG. 1
FIG. 1a
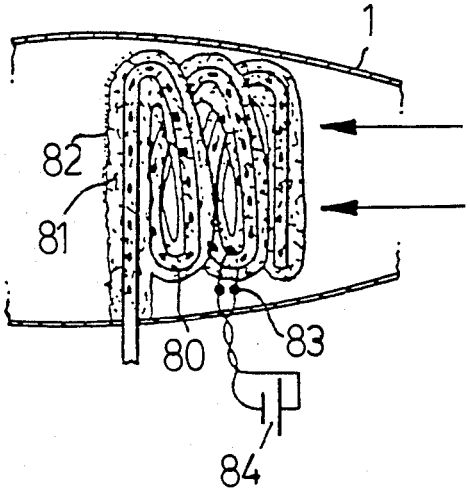
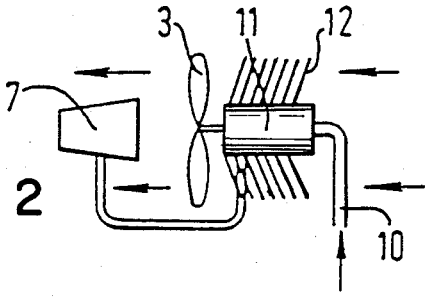
FIG. 2

HAIR DRYING APPARATUS

This invention relates to a hair drying apparatus and is primarily concerned with a portable apparatus which may function independently of a mains power supply.

Conventional hand held hair dryers, even small size units, require an electrical power input of some 250 watts or more principally to provide sufficient heating of the air flow. Power is also consumed by the air impeller means which may be a tangential, centrifugal or axial electric fan. It is impractical to obtain this order of electrical power from storage batteries.

Hand held dryers achieve the drying effect through air flow to speed-up natural evaporation and heat to further assist the evaporation process. Practicalities dictate a fiarly narrow range of combination of air flow and heat to obviate damage and prevent discomfort both physical and aural. Relative humidity in the environment of use of the dryer also considerably effects the drying.

In one aspect this invention seeks to provide a hair-dryer which is portable, operating independently of a fixed power source. In a second aspect the invention provides an improved hair dryer apparatus, preferably portable, to achieve a better and quicker drying process independently of atmospheric conditions.

According to this invention there is provided hair drying apparatus having a body unit, air impelling means to draw air through the body from an inlet and to expel same through an outlet nozzle, and a heating means disposed within the air flow to heat the air during passage from the inlet to the outlet, the body being tubular with the air inlet at one end and the air impelling means located within the body at said end, characterized by the heating means being supplied with heat from a gas burner located within the body and connected by a gas feed duct to a gas reservoir within a hand grip secured to the body, the air outlet nozzle being provided at the other end of the body.

The burner may be a flame burning kind or a catalytic combustion device which is flameless. Preferably the burner is screened from the air flow and incorporates a flame detector means operative to shut off the gas supply in the event of flame failure. The burner unit may be positioned within the air flow to transfer heat to the air passing thereover or by using a heat pump as the burner means the burner itself may be remotely located out of the air flow, for example in a part of the apparatus integral with the body unit.

The gas may be contained within a body part, such as the handle, and may be contained in a removable and replaceable cartridge or a container refillable from an external gas bottle.

The gas used preferably will comprise mainly butane stored in liquid form. In one embodiment the gas is acetylene produced preferably by the action of water on calcium carbide, suitably contained integrally or at a remote location.

The air impelling means may be driven by a turbine supplied with pressure gas or within the gas flow path to the burner, said path being preferably heated by the burner to increase the energy in the gas to operate the turbine.

In order to provide a more time-efficient drying process the invention also proposes a hair drying apparatus including a cooling means to condense moisture from the air drawn in prior to heating. Such an arrangement ensures that the air has a reasonable water absorbing capacity even under conditions of high humidity. Quicker drying can thus be produced at lower air temperatures.

The cooling mens may be integrated with the gas burner and may include a refrigerant circuit heated by the gas burner with heat being given up to the air flow prior to expansion producing the cooling of the intake air. The arrangement may comprise a combined regrigerating means and heat pump. The gas supply may be used as the refrigerant being initially heated by the burner to drive the turbine and to give up heat prior to the heating of the air flow by the burner and the thereafter expand to absorb heat by cooling the intake air flow, the gas being then fed to the burner.

By simultaneous use of the gas to heat the air flow and cool same good efficiency in the overall cycle is obtained, being an open cycle where the refrigerant is the gas. A closed cycle using a separate refrigerant can be used in which case the turbine used for the air flow may drive a compressor. An absorptive (Electruolux) refrigerant system could, however, be used.

The apparatus using the cooling means could be electrically powered using electric power means for the refrigerant system and air impeller and gas for the heating.

The gas storage cylinder may be made heatable by the gas burner whereby the pressure energy in the gas for expansion is increased, in such a case the gas storage cylinder can be made rechargeable from a supply cylinder giving a capacity sufficient for a normal operation.

Figure 4:
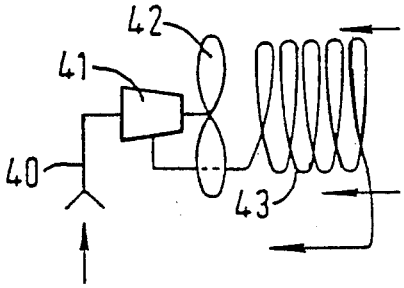
Figure 5:
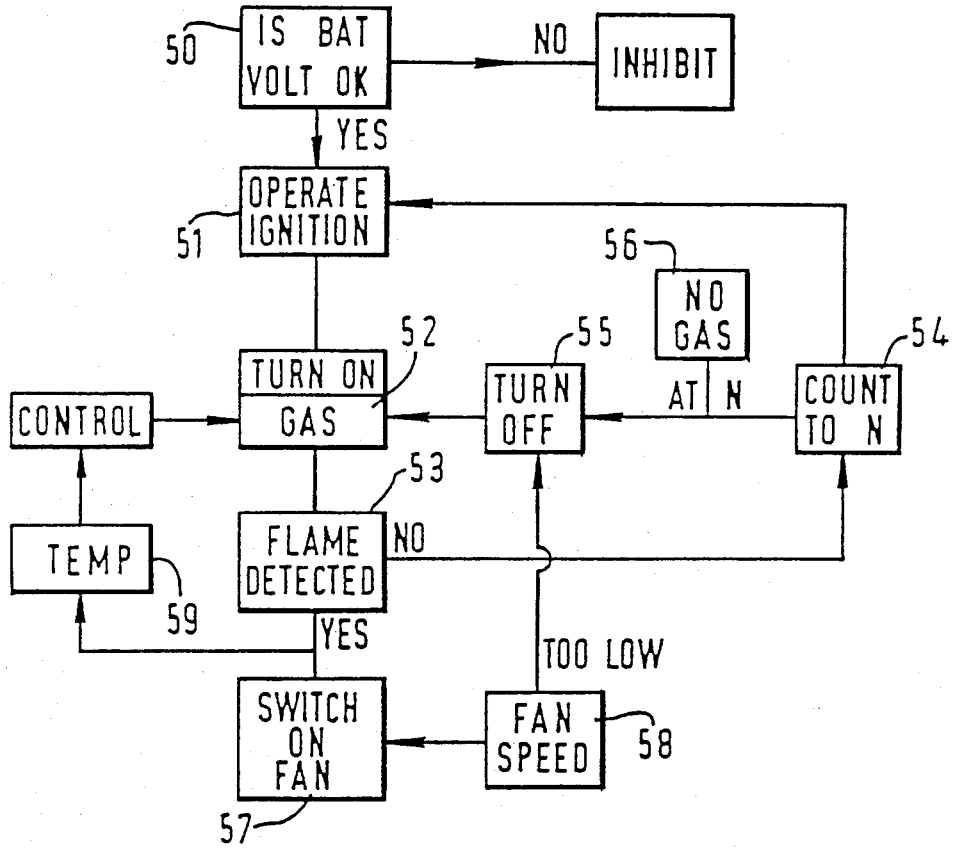
Figure 6:
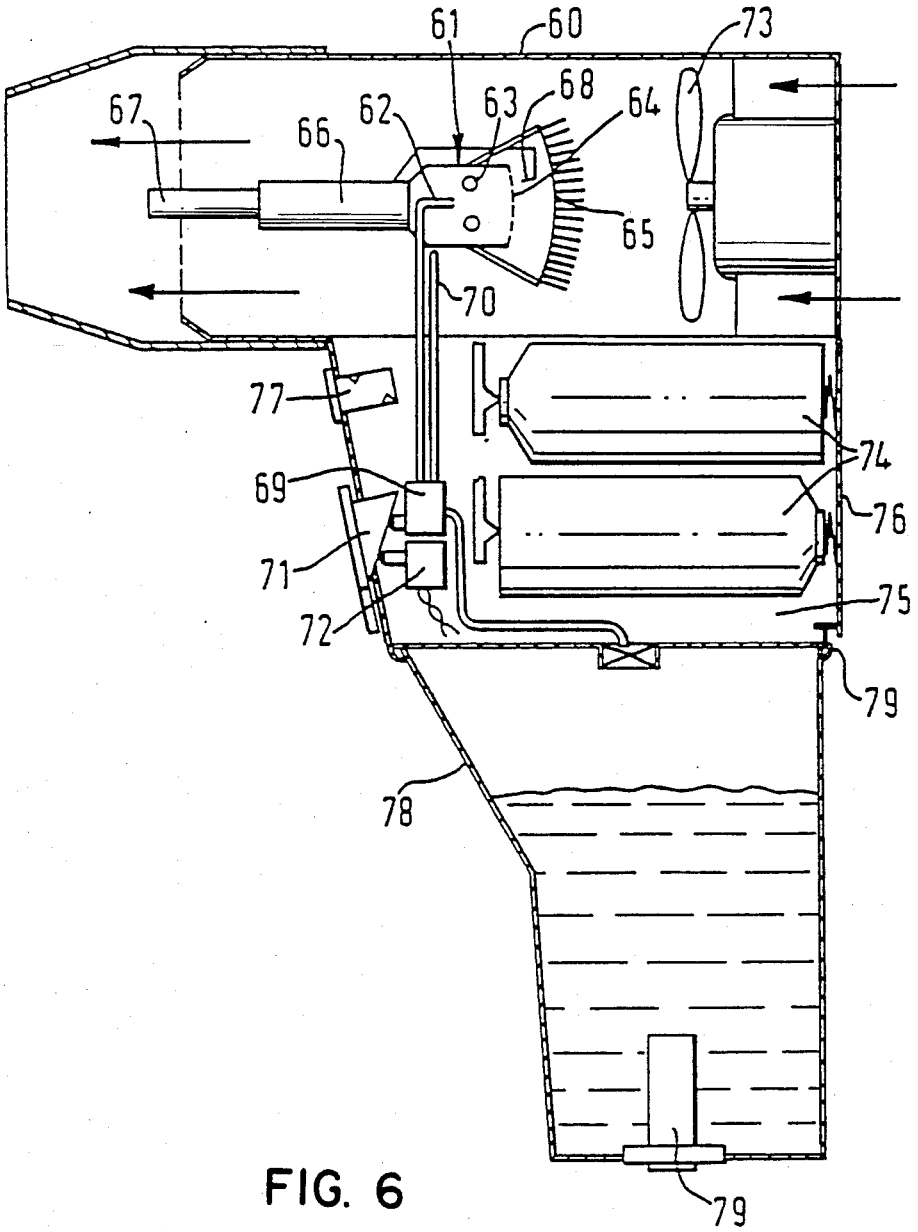

Embodiments according to this invention are shown by way of examples only in the accompanying drawings, wherein:

FIG. 1 shows a side sectional part view of one embodiment,

FIG. 1*a* shows a detail of an alternative catalytic combustion heating device, FIG. 2 illustrates a modification, FIG. 3 shows a second embodiment, FIG. 4 shows a modification of the embodiment of FIG. 3, FIG. 5 shows a control circuit diagram, and FIG. 6 shows a further embodiment.

Referring to FIG. 1 this shows part of a hand held hair dryer comprising a tubular housing 1 with an air inlet 2, electric air impeller mens 3 and a gas burner 4. Heated air is expelled through nozzle outlet 5. The burner 4 includes a flame shielding plate 6 provided with fins 7 to dissipate the heat of combustion and a burner body 7*a* having further fins.

The air inlet to the burner may be positioned such that the forced draught of the air flow passes therein to provide for combustion of high gas flow rates than would otherwise be possible.

A slide valve and switch or trigger 8 forms a control device which initiates flow of gas and operates an igniter preferably an electrical means such as a piezo-electric device or hot wire. The gas flow may include a valve only opened when the supply voltage is sufficient to operate the igniter. A flame or temperature detector may be included to operate the impeller 3 only when the burner is lit.

The trigger 8 may be a slide or other two way switch serving to open a gas valve 8*a* and close switch 8*b* to drive the fan by battery 8*c*. The gas may be ignited by a separate switch 8*d* and igniter element 8*e*.

Alternatively the burner may be of a catalytic or flameless kind as shown in FIG. 1*a*. This comprises a coiled length of tubing 80 which is perforated and around which is wrapped a catalyst such as asbestos fibre 81 dipped in a salt of platinum retained by a fine wire mesh 82 and an initiator comprising a wire 83 heated by a battery 84. This assembly may be encased within a heat radiating shroud.

The gas supply may comprise a cartridge C insertable into a handle 9 integral with housing 1 or a gas container may be provided in the handle which is charged from an external cylinder or refill container, the charge being sufficient for one normal operation. The handle may also include a battery, preferably rechargeable nickel cadmium or sealed lead-acid, to drive the impeller 3 and power the igniter and flame sensor circuit.

As an alternative both the gas supply and battery can be housed within a portable carrying case and connected to the dryer by flexible piping and cable preferably integrated into a single pipe. The carrying case may then include a battery charger.

FIG. 2 shows a modification in which the high pressure gas supply 10 feeds a turbine 11 forming also a pressure reducer to drive the impeller 3 and thence to the burner 7. The gas used conveniently is a butane or propane mix, the latter being preferred for the arrangement of FIG. 2 in view of the higher pressure available at normal temperatures. The gas may however be preheated by passage through the burner assembly and in one arrangement the gas storage cylinder is associated, thermally, with the burner. The cylinder being charged prior to use and absorbing a part of the burner heat output to drive the turbine.

In a modification applicable to all embodiments described the fan is driven by a turbine powered from a compressed $CO_2$ gas cartridge or other inert propellant compounds such as those used in domestic aerosol sprays.

Expansion through the turbine reduces the gas temperature and heat may be absorbed from the inlet air flow by fins 12 to lower the dew point and condense excessive water vapour from the air prior to heating thus giving an enhanced drying effect.

FIG. 3 shows an embodiment wherein a gas storage cylinder 30 or coil is charged once or repetitively through valve 31 from a cartridge 32. The charge cylinder 30 is thermally associated with a gas burner 32 and the high temperture pressurised gas is cooled through a coil 33 which precedes the burner in the direction of air flow from impeller 34. The gas is expanded through a turbine 35 to drive the impeller and thereafter through a coil or finned unit 36 where heat is absorbed from the incoming air flow to reduce the dew point and condense out excess water vapour which is passed to a drain 37.

The expanded gas then passes to the burner. This arrangement provides for some adjustment in the requirement for high gas pressure energy to drive the turbine which might otherwise provide a gas volume in excess of that needed to heat the air. The refrigeration cycle provides a means of reducing the effective burner heat output. A separate refrigerant circuit could be used.

If the gas pressure is sufficiently great then the embodiment of FIG. 4 provides for the supply 40 to be fed to the turbine 41 directly to drive impeller 42 and thence to the absorption coil 43 to effect cooling of the incoming air.

A valve will advantageously be included in the gas feed to the gas burner, the valve being thermostatically controlled to reduct the gas supply as the temperature rises. The valve may be manually set to provide temperature control.

The gas driven turbine for the impeller may be coupled with an electrical impeller means to provide a constant air flow regardless of gas flow; the gas driven turbine being assisted by the electric impeller as required.

A logic control diagram for the ignition means is illustrated in FIG. 5, comprising a battery voltage sensor 50 to determine if sufficient power is available for correct control followed by an ignaition device 51 which turns on the gas supply 52 and effects ignition. If no gas flame or combustion is detected at 53 the ignition is reoperated but only N number of times determined by counter 54 after which the gas is shut off at 55 and a no-gas ignition indicator 56 lights. If a flame is detected the fan 57 is switched on, if electric, and the speed monitored at 58, in addition the outlet air temperature is monitored at 59, if either falls outside limits the gas is shut off. In the event of flame-cut the igniter may be reoperated or overridden to shut off the gas.

The burner may be arranged so that combustion products do not enter the air flow by provision of ducts or shrouds. Such an arrangement will result in heat being lost and this is minimised by extracting as much heat as possible from the combustion gases before exhausting same.

A further embodiment is shown in FIG. 6 of the drawings wherein a cylindrical casing 60 has mounted coaxially therein a burner assembly 61 comprising a jet 62 with air inlet orifices 63 and a burner head 64. The burner head is shrouded by a screen 65 incorporating heat radiating fins and the whole burner may further be constructed with a large surface area by using fins in order to dissipate heat to the air. Associated with the burner is a piezo-electric igniter 66 with a manually operable button 67 which may be pressed so as to cause a spark to jump between electrodes 68 and the burner head thus igniting the gas. Gas is fed from a control valve 69 which is iperatively coupled with a capillary 70 containing a fluid serving as a temperature sensing means whereby the valve progressively closes on increasing temperature. The valve 69 also functions to switch the gas on or off through a manual slide switch 71 which operates an electrical switch 72 connecting an electrically driven impeller 73 to rechargeable batteries 74. In the assembly shown four batteries 74 are provided within a base portion 75 integral with the housing 60. A cover 76 enables the batteries to be removed if necessary and an electrical connector socket 77 enables them to be recharged from an external unit. Gas supply to the valve 69 is taken from storage container 78 forming the lower part of the handle and this may include a refill valve 79 in its base. By constructing the handle of circular form the container 78 may be unscrewed at a coupling joint 79 and replaced when exhausted rather than being refilled. Alternatively, the container 78 may be permanently bonded to the battery compartment 75 to form an integral rugged assembly.

An alternative or additional temperature control means may be provided comprising a thermistor mounted closely adjacent the burner and connected either directly or indirectly through a control means into the fan circuit 73. This thermistor is arranged so that increasing temperature at the burner decreases its resistance thereby increasing the speed of the fan 73 and hence the flow rate of the air by which means a substantially constant safe air temperature can be maintained albeit with varying rate of air throughput.

A further construction which avoids the flame burner would incorporate a catalytic device as indicated in FIG. 1*a*, the arrangement otherwis being generally similar to that shown. In this arrangement a hot wire would be used to initiate gas combustion rather than the piezo-electric device 66.

We claim:

1. Hair drying apparatus comprising a tubular body with an air inlet at one end, an electric motor at said end, an air impeller driven by said motor to draw air in through the air inlet, propel the air through the body and out through an outlet nozzle at the other end of the body, a heating means disposed within the body between said impeller and said air outlet nozzle, said heating means comprising a gas burner assembly including a coiled tube positioned within the air-flow, one end of the tube being fed with a combustible gas mixture, the tube having apertures spaced along its length, a fibrous catalyst material around the outside thereof, a support wire on which said fibrous catalyst material is retained, a housing secured to and beneath the body, the housing containing an electric power source connected through switch means to drive said electric motor, a gas flow valve operably coupled with the switch means and to a trigger mounted on the housing for manual operation, a pressurised liquid gas container connected with the housing and extending to form therewith a handgrip, a gas refilling valve assembly at the base of said gas container, a gas duct connecting the said container with the burner through said gas flow valve, ignition means to initiate combustion of the gases, and a temperature sensing means operable to close a valve in the gas feed when the burner temperature rises above a predetermined maximum.

2. Apparatus in accordance with claim 1 wherein the air impelling means throughput is controlled by a themistor connected in the supply to an electric motor driving the impeller, the air flow being increased as the temperature at the burner rises.

* * * * *